United States Patent [19]

Edwards

[11] 4,184,570

[45] Jan. 22, 1980

[54] WALL-MOUNTED FORK LIFT

[76] Inventor: James W. Edwards, 819 NW. 49th, Seattle, Wash. 98107

[21] Appl. No.: 901,115

[22] Filed: Apr. 28, 1978

[51] Int. Cl.[2] ..... B66B 9/00

[52] U.S. Cl. ..... 187/6; 414/670; 414/785

[58] Field of Search ..... 187/6, 7, 1 R, 3, 11, 187/9; 214/750, 731; 414/670, 785

[56] References Cited

U.S. PATENT DOCUMENTS

| | | | |
|---|---|---|---|
| 2,236,019 | 3/1941 | Thompson | 187/6 |
| 2,569,653 | 10/1951 | Boedecker | 187/7 |
| 3,800,915 | 4/1974 | Himes | 187/1 R |
| 3,866,780 | 2/1975 | Miller et al. | 214/731 |

FOREIGN PATENT DOCUMENTS

| | | | |
|---|---|---|---|
| 744226 | 10/1966 | Canada | 187/6 |

*Primary Examiner*—David M. Mitchell
*Attorney, Agent, or Firm*—Daniel Jay Tick

[57] ABSTRACT

A wall-mounted fork lift has a pair of support arms hingedly affixed to support members which move up and down along a pair of guide rails mounted on a vertical wall. The support arms are mounted for movement to a rest position in close proximity with the wall and to an operating position perpendicular to the wall. The support arms have pallet-supporting devices extending therefrom for supporting a loaded pallet between them.

2 Claims, 4 Drawing Figures

FIG. 1
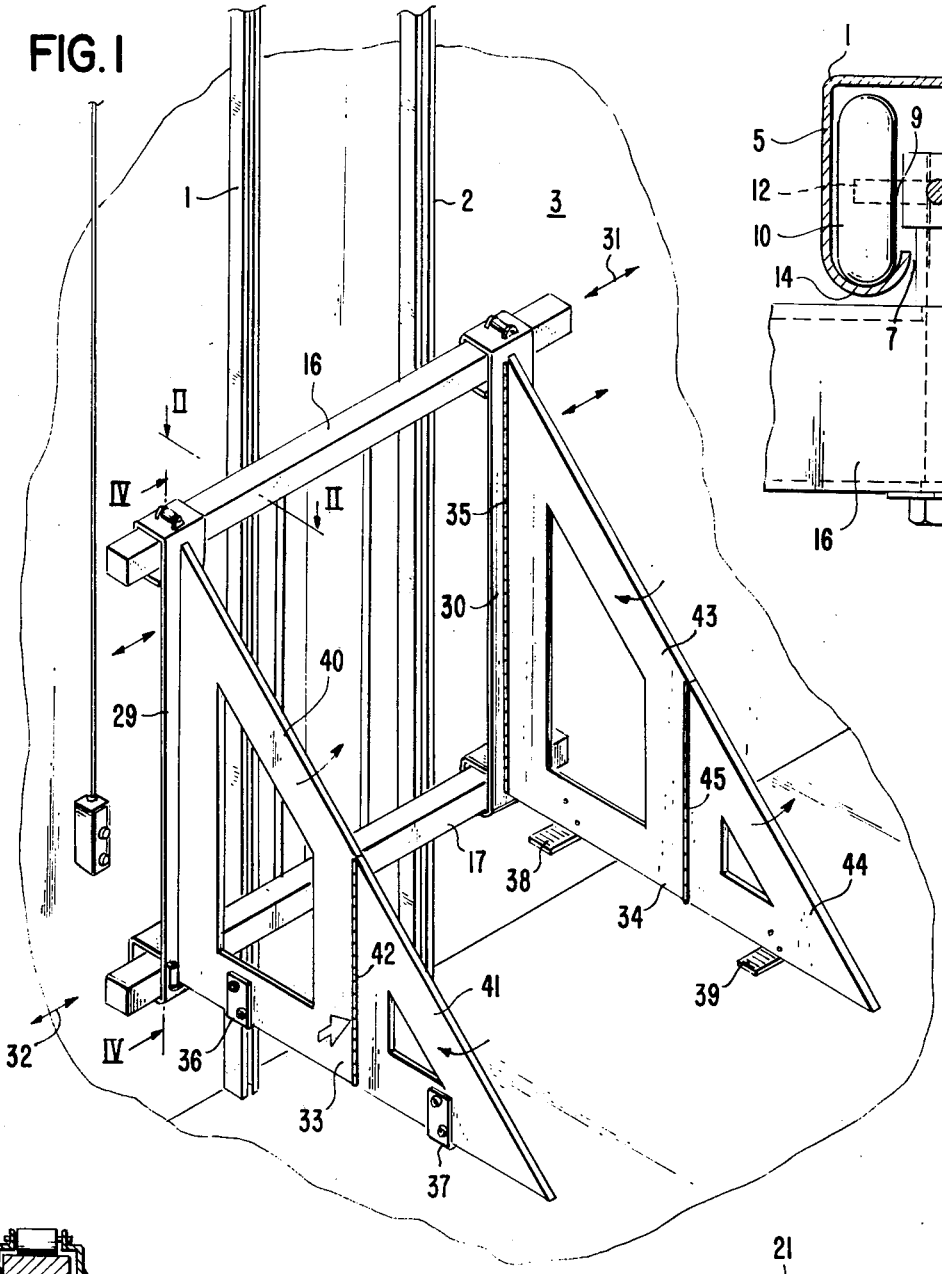
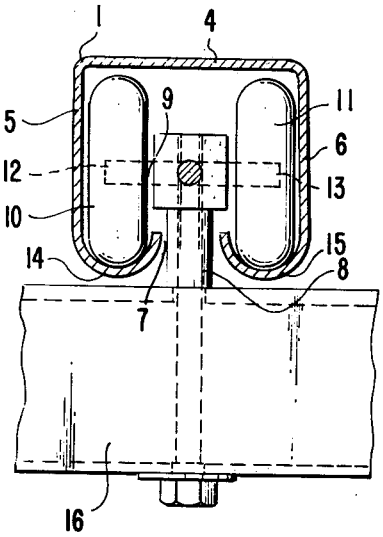
FIG. 2
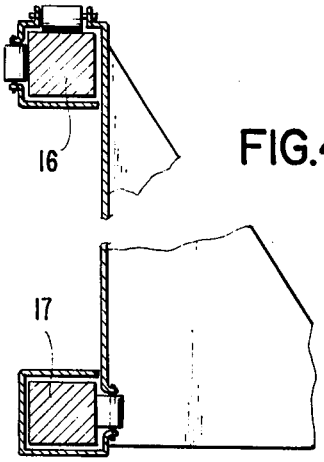
FIG. 4
FIG. 3
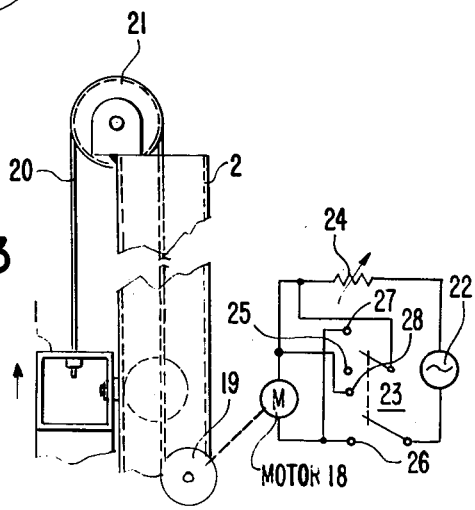

WALL-MOUNTED FORK LIFT

BACKGROUND OF THE INVENTION

The present invention relates to a wall-mounted fork lift.

Fork lifts similar to that described herein are disclosed in U.S. Pat. Nos. 489,368; 638,080; 2,236,019; 3,490,616; 3,613,834 and 3,820,632.

Objects of the invention are to provide a wall-mounted fork lift of simple structure, which is inexpensive in manufacture, and functions efficiently, effectively and reliably to move heavy pallet loads in a restricted area in which the use of a fork lift truck is not feasible due to limited space.

BRIEF DESCRIPTION OF THE DRAWINGS

In order that the invention may be readily carried into effect, it will now be described with reference to the accompanying drawings, wherein:

FIG. 1 is a perspective view of an embodiment of the wall-mounted fork lift of the invention;

FIG. 2 is a view, on an enlarged scale, partly in section, taken along the lines II—II, of FIG. 1;

FIG. 3 is a schematic diagram illustrating the motive system of the embodiment of FIG. 1; and FIG. 4 is a view, on an enlarged scale, partly in section, taken along the lines IV—IV, of FIG. 1.

DETAILED DESCRIPTION OF THE INVENTION

The wall-mounted fork lift of the invention comprises a pair of spaced parallel guide rails 1 and 2 (FIG. 1) affixed to a wall 3 and extending substantially vertically on said wall. Each of the guide rails 1 and 2 preferably comprises a channel member of generally square cross-section having a back 4 and a pair of sides 5 and 6 extending perpendicularly from the back, as shown in FIG. 2. The front preferably has a slot 7 formed therethrough and extending along the length thereof at the center thereof to enable a support shaft 8 to extend from the guide rail. An axle 9 is mounted at the end of the support shaft 8 in the guide rail 1 perpendicularly thereto. A pair of rollers 10 and 11 are rotatably affixed to the spaced opposite ends 12 and 13 of the axle 9 and rotate on the inside surface of the front parts 14 and 15 of the guide rail. The front parts 14 and 15 of the guide rail 1 are preferably of convex semicylindrical configuration to accommodate the rollers 10 and 11, respectively, thereof.

A first pair of spaced parallel support members 16 and 17 (FIGS. 1 and 4) are movably mounted on the guide rails 1 and 2 for movement therealong. The support members 16 and 17 extend perpendicularly to the guide rails 1 and 2.

A motive system is coupled to the first pair of support members 16 and 17 for selectively moving said support members along the guide rails 1 and 2. The motive system comprises a motor 18 coupled to and driving a pulley wheel 19 on which is wound a support cable 20. The support cable 20 extends around a pulley 21 at the top of each of the guide rails 1 and 2. As shown in FIG. 3, the motor 18 is an electric motor and is energized by a source of electrical energy 22 of any suitable type such as, for example, a commercial power source, via a motor reversing switch 23 and a speed control device 24. The speed control device 24 comprises a variable resistor for varying the current supply to the motor and thereby varying the speed thereof. The motor reversing switch 23 is a double pole, double throw switch which, when closed on a first pair of contacts 25 and 26, causes the motor 18 to rotate in one direction, and when closed on a second pair of contacts 27 and 28, causes the motor to rotate in the opposite direction, thereby providing up and down movement of the fork lift, as desired.

Third and fourth support members 29 and 30 extend between the first pair of support members 16 and 17, perpendicularly thereto, and are movably mounted thereon for independent movement therealong in directions, indicated by arrows 31 and 32 in FIG. 1, perpendicular to the guide rails 1 and 2, as shown in FIG. 1.

First and second support arms 33 and 34, respectively, are hingedly affixed to the third and fourth support members 29 and 30, respectively, as shown in FIG. 1, by any suitable hinge arrangement such as, for example, a linearly extending hinge 35, shown in FIG. 1, which affixes the second support arm 34 to the fourth support member 30. The hinges affixing the first and second support arms 33 and 34 to the third and fourth support members 29 and 30, respectively, permit movement of said support arms to a rest position (not shown in the FIGS.) in which said first and second support arms are next-adjacent said third and fourth support members in close proximity with the wall 3. The hinges affixing the first and second support arms 33 and 34 to the third and fourth members 29 and 30, respectively, permit movement of said support arms to an operating position, shown in FIG. 1, in which said support arms are substantially perpendicular to the wall 3.

The support arms 33 and 34 have pallet-supporting devices 36 and 37, and 38 and 39, respectively, extending therefrom for supporting a loaded pallet (not shown in the FIGS.) between them. The pallet-supporting devices 36 and 37 extend toward the pallet-supporting devices 38 and 39 when the first and second support arms are in their operating position, as shown in FIG. 1.

The first support arm 33 has a first part 40 hingedly affixed to the support member 29 and a second part 41 hingedly affixed to said first part via any suitable hinge device such as, for example, a linearly extending hinge 42 (FIG. 1). The second support arm 34 has a first part 43 hingedly affixed to the fourth support member 30 and a second part 44 hingedly affixed to said first part via any suitable hinge device such as, for example, a linearly extending hinge 45 (FIG. 1). Each of the first and second support arms 33 and 34 has a right triangular shape, as shown in FIG. 1, with one arm adjacent the corresponding one of the third and fourth support members and the other arm perpendicular to the corresponding support member. The first and second parts 40 and 41 of the first support arm 33 and the first and second parts 43 and 44 of the second support arm 34 are hingedly affixed to each other along a line parallel to said one arm and spaced therefrom, as shown in FIG. 1.

While the invention has been described by means of a specific example and in a specific embodiment, I do not wish to be limited thereto, for obvious modifications will occur to those skilled in the art without departing from the spirit and scope of the invention.

I claim:

1. A wall-mounted fork lift, comprising a pair of spaced parallel guide rails affixed to a wall and extending substantially vertically thereon;

a first pair of spaced parallel support members movably mounted on the guide rails for movement therealong, said support members extending perpendicularly to said guide rails;

motive means coupled to the first pair of support members for selectively moving said support members along said guide rails;

third and fourth support members extending between said first pair of support members perpendicularly thereto and movably mounted thereon for independent movement therealong in directions perpendicular to said guide rails; and first and second support arms hingedly affixed to the third and fourth support members, respectively, for movement to a rest position substantially next-adjacent said third and fourth support members in close proximity with the wall and to an operating position substantially perpendicular to said wall, said support arms having pallet-supporting means extending therefrom for supporting a loaded pallet between them, each of said first and second support arms having a first part hingedly affixed to the corresponding one of the support members and a second part hingedly affixed to the first part.

2. A wall-mounted fork lift as claimed in claim 1, wherein each of the first and second support arms has a right triangular shape with one leg of the triangular shape next-adjacent the corresponding support member and the other leg of said triangular shape perpendicular to said support member, and the first and second parts of each of said first and second support arms are hinged along a line parallel to said one leg and spaced therefrom.

* * * * *